US008408541B2

(12) United States Patent
Song

(10) Patent No.: US 8,408,541 B2
(45) Date of Patent: Apr. 2, 2013

(54) METHOD AND APPARATUS FOR CONTROLLING TRANSFER OF PAPER

(75) Inventor: Hyun-soo Song, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 203 days.

(21) Appl. No.: 12/252,771

(22) Filed: Oct. 16, 2008

(65) Prior Publication Data

US 2009/0108523 A1 Apr. 30, 2009

(30) Foreign Application Priority Data

Oct. 26, 2007 (KR) ..... 10-2007-0108440
Feb. 28, 2008 (KR) ..... 10-2008-0018521

(51) Int. Cl.
*B65H 9/04* (2006.01)

(52) U.S. Cl. ..... 271/242; 271/258.01; 271/226

(58) Field of Classification Search ..... 271/258.01, 271/226, 242, 256
See application file for complete search history.

(56) References Cited

U.S. PATENT DOCUMENTS

| | | | | |
|---|---|---|---|---|
| 5,482,265 | A * | 1/1996 | Nakazato et al. | 271/242 |
| 5,612,776 | A * | 3/1997 | Machino et al. | 399/43 |
| 6,691,998 | B2 * | 2/2004 | Mori | 271/9.05 |
| 7,171,153 | B2 * | 1/2007 | Eguchi | 399/391 |
| 7,237,772 | B2 * | 7/2007 | Kamamura | 271/9.01 |
| 7,370,863 | B2 * | 5/2008 | Yasui et al. | 271/270 |
| 2004/0217538 | A1 * | 11/2004 | Kawamura | 271/9.01 |

FOREIGN PATENT DOCUMENTS

| | | | |
|---|---|---|---|
| JP | 2002029649 | A * | 1/2002 |
| KR | 10-2005-0015881 | | 2/2005 |

* cited by examiner

*Primary Examiner* — Michael McCullough
*Assistant Examiner* — Howard Sanders
(74) *Attorney, Agent, or Firm* — Staas & Halsey LLP

(57) ABSTRACT

A method and apparatus for controlling transfer of paper. In order to align the leading end of a sheet of paper, when the sheet arrives at a predetermined position in an image forming apparatus, a registration unit is stopped from operating and a driving unit that transfers the sheet from an auxiliary paper-feeding unit is also stopped from operating so that bending and crumpling of the sheet can be minimized.

19 Claims, 4 Drawing Sheets

METHOD AND APPARATUS FOR CONTROLLING TRANSFER OF PAPER

CROSS-REFERENCE TO RELATED APPLICATIONS

This application claims the benefit of Korean Patent Application Nos. 2007-108440, filed on Oct. 26, 2007, and 2008-18521, filed on Feb. 28, 2008 in the Korean Intellectual Property Office, the disclosures of which are incorporated herein by reference.

BACKGROUND OF THE INVENTION

1. Field of the Invention

Aspects of the present invention relate to a method and apparatus for controlling the transfer of paper, and more particularly, to a method and apparatus for controlling the transfer of paper that is fed into a color image forming apparatus.

2. Description of the Related Art

As the printing speed of printers has increased, there are times when the printers cannot efficiently supply a sufficient number of sheets of paper when the printer only has a primary paper-feeding unit and a large number of pages needs to be printed. In those situations, a user has to load paper frequently in order to print the large number of pages. To solve such inconveniences, an auxiliary paper-feeding unit is used that is detachable from the printers, contains a large number of sheets of paper, and can be used even in different printers. However, in order to use such an auxiliary paper-feeding unit on different printers, the auxiliary paper-feeding unit must be customized each time to correspond to the structure and performance of each of the printers, so that a sheet of paper can be reliably transferred to that particular printer and be printed.

A procedure for transferring a sheet of paper loaded in an auxiliary paper-feeding unit will now be described. When a printer starts printing, the sheet loaded in the auxiliary-paper feeding unit is transferred to the printer by action of a driving unit of the auxiliary-paper feeding unit. When the sheet is transferred to the printer, the printer aligns the leading end of the sheet to minimize skewing of the printed image. More specifically, the printer stops the driving force of a registration unit that moves the leading end of the sheet, and aligns the leading end of the sheet while an image is formed on a photosensitive drum of the printer. While the printer is aligning the leading end of the sheet, the driving unit of the auxiliary paper-feeding unit continuously transfers the sheet, and thus the sheet can be crumpled between the registration unit and the driving unit.

Especially, in the case of a color printer, since the photosensitive drum of a color printer needs an image to be formed on the photosensitive drum more than three times, it takes a substantial amount of time to form the image on the photosensitive drum, and consequently, the time consumed to align the leading end of the paper increases, thereby causing more serious bending or crumpling of the sheet than occurs in a black-and-white printer.

SUMMARY OF THE INVENTION

Aspects of the present invention provide a method of controlling the transfer of paper in order to form an image while minimizing bending or crumpling of a sheet of paper by stopping the operation of a registration unit and then stopping the operation of a driving unit of an auxiliary paper-feeding unit that transfers the sheet loaded in the auxiliary paper-feeding unit in order to align a leading end of the sheet when the sheet arrives at a predetermined position of an image forming apparatus. Aspects of the present invention also provide a computer readable recording medium having embodied thereon a computer program for executing the method.

One embodiment of the present invention provides a method of controlling transfer of paper, the method comprising: stopping operation of a registration unit when a sheet of paper that is transferred from an auxiliary paper-feeding unit of an image forming apparatus arrives at a predetermined position of the image forming apparatus so as to align a leading end of the sheet; and stopping operation of the driving unit of the auxiliary paper-feeding unit that transfers the sheet.

Another embodiment of the present invention provides a computer readable recording medium having embodied thereon a computer program for executing the method of controlling the transfer of paper.

Another embodiment of the present invention provides an apparatus for controlling transfer of paper, the apparatus comprising: a first driving unit that transfers a sheet of paper loaded in a first auxiliary paper-feeding unit; a registration unit that aligns a leading end of the sheet and transfers the sheet; and a control unit that stops operations of the registration unit and the first driving unit when the leading end of the sheet that has been transferred from the first auxiliary paper-feeding unit arrives at a predetermined position.

Another embodiment of the present invention provides an apparatus for controlling transfer of paper, the apparatus comprising: a first driving unit that transfers a sheet of paper loaded in a first auxiliary paper-feeding unit; a registration unit that aligns a leading end of the sheet and transfers the sheet; a first control unit that stops operation of the registration unit when the leading end of the sheet that has been transferred from the first auxiliary paper-feeding unit arrives at the registration unit; and a second control unit that stops operation of the first driving unit when the registration unit stops operating.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
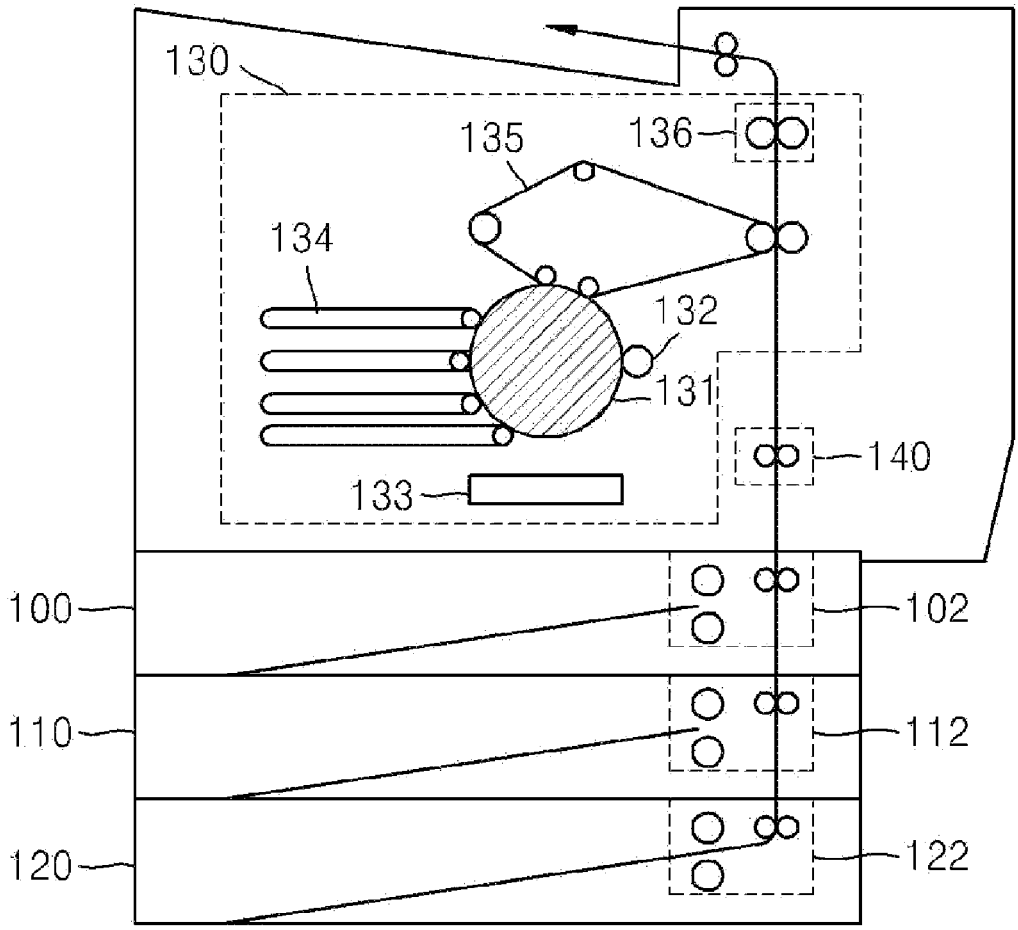
FIG. 1 is a diagram of an image forming apparatus that controls the transfer of paper according to a first embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a diagram of an image forming apparatus that controls the transfer of paper according to a first embodiment of the present invention. The image forming apparatus includes a primary paper-feeding unit 100, a first auxiliary paper-feeding unit 110, a second auxiliary paper-feeding unit 120, an image forming unit 130, and a registration unit 140. The paper can be any flat print medium including, but not limited to, paper of various types and thicknesses, other paper-like materials, transparencies, and the like.

Each of the primary paper-feeding unit 100, the first auxiliary paper-feeding unit 110, and the second auxiliary paper-feeding unit 120 takes paper that has been loaded from the outside into the primary paper-feeding unit 100, the first auxiliary paper-feeding unit 110, and the second auxiliary paper-feeding unit 120, respectively, and then transfers the loaded paper to the image forming unit 130. Furthermore, the primary paper-feeding unit 100, the first auxiliary paper-feeding unit 110, and the second auxiliary paper-feeding unit 120, respectively, include driving units 102, 112, and 122 that transfer the paper to the image forming unit 130. Each of the driving units 102, 112, 122 may include at least one of a pick-up roller or a feed roller. Although in this first embodiment the image forming apparatus includes only the two first and second auxiliary paper-feeding units 110 and 120, the present invention is not limited thereto, and thus, more auxiliary paper-feeding units may be employed. The auxiliary units can be auxiliary paper trays that are installed in the image forming apparatus or auxiliary units that can be detached and used with more than one image forming apparatus.

The image forming unit 130 forms an image on a sheet of paper transferred from one of the primary, first auxiliary, and second auxiliary paper-feeding units 100, 110, and 120, and outputs the sheet to the outside of the image forming apparatus. The image forming unit 130 includes a photosensitive drum 131, a charge roller 132, a light scanning unit 133, and a developing unit 134, a transfer belt 135, and a fixing roller 136.

Light corresponding to the image is scanned onto the photosensitive drum 131 before the image is printed on the sheet of paper. The charge roller 132 charges a surface of the photosensitive drum 131 evenly using a high voltage produced by a high-voltage power generating unit (not shown). The light scanning unit 133 forms a latent image corresponding to the image to be printed by scanning light onto the photosensitive drum 131 as the photosensitive drum 131 rotates. The latent image formed by the light scanning unit 133 on the surface of the photosensitive drum 131 is referred to as an electrostatic latent image.

The developing unit 134 develops a visible image by providing toner particles to the latent image that is on the photosensitive drum 131. If the image forming apparatus 130 is a color image forming apparatus, the developing unit 134 generally includes sections for developers of yellow, magenta, cyan, and black, and prints the desired color by combining in order the colors of yellow, magenta, cyan, and black. The transfer belt 135 transfers the toner particles, adhered to the surface of the photosensitive drum 131, to the front side of the sheet. To form the image, the fixing roller 136 fixes the toner particles firmly onto the sheet by applying pressure and heat to the sheet, so as to melt the toner particles.

The registration unit 140 aligns a leading end of the sheet transferred from one of the primary, first auxiliary, and second auxiliary paper-feeding units 100, 110, and 120 during the time when the image is being formed onto the surface of the photosensitive drum 131 of the image forming unit 130. In order to accomplish this alignment, the registration unit 140 stops the driving force that transfers the sheet so as to align the leading end of the sheet.

Figure 2:
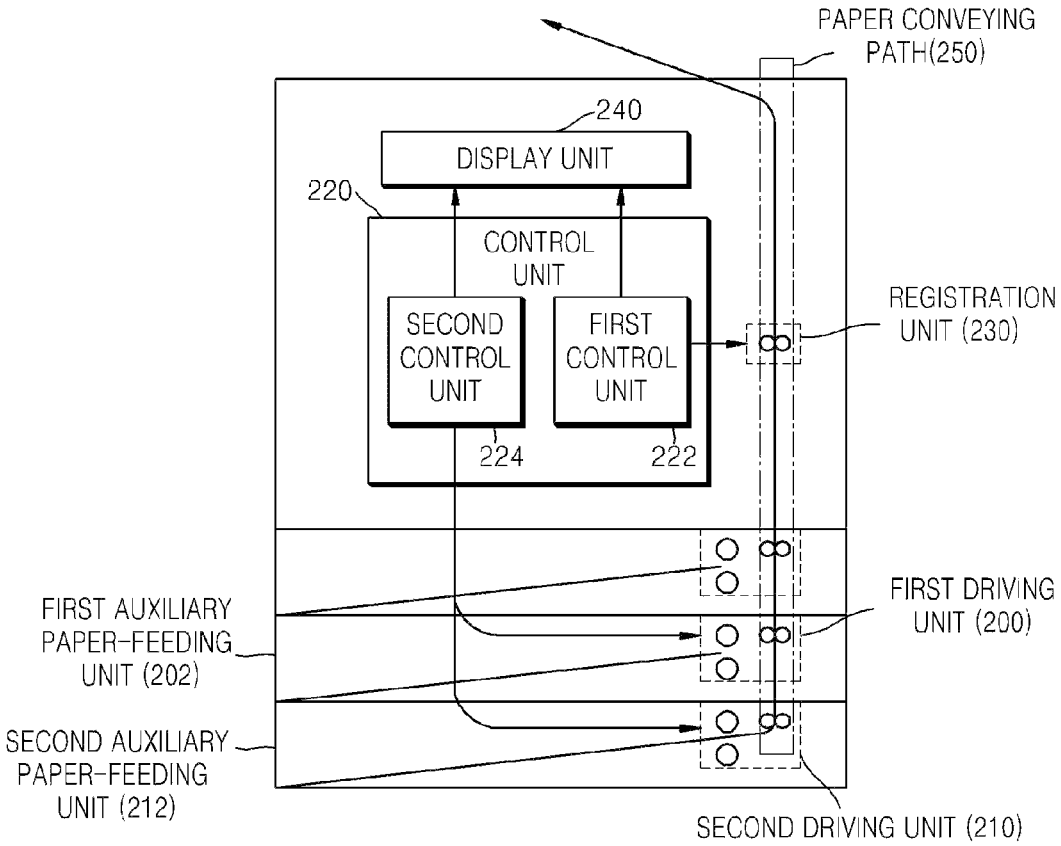
FIG. 2 is a diagram of an apparatus for controlling the transfer of paper according to a second embodiment of the present invention.

FIG. 2 is a diagram of an apparatus for controlling the transfer of paper according to a second embodiment of the present invention. The apparatus according to this second embodiment includes a first driving unit 200, a second driving unit 210, a control unit 220, a registration unit 230, and a display unit 240. The first driving unit 200 is located in the first auxiliary paper-feeding unit 202, and the second driving unit 210 is located in the second auxiliary paper-feeding unit 212.

Hereinafter, the procedure of controlling the transfer of paper will be described with reference to FIGS. 1 and 2. The first driving unit 200 of the first auxiliary paper-feeding unit 202 moves a sheet of paper along a paper conveying path 250 to the registration unit 230. The first driving unit 200 may be formed of two rollers contacting each other, and the sheet located between the two rollers is transferred along the paper conveying path 250 to the registration unit 230 by the rotation of the rollers of the first driving unit 200.

The registration unit 230 aligns the leading end of the sheet and transfers the sheet. When the sheet of paper loaded in the first auxiliary paper-feeding unit 202 is moved along the paper conveying path 250, and when the leading end of the sheet reaches the registration unit 230, the control unit 220 stops the operation of the registration unit 230 and the first driving unit 200. Also, when the image has been completely formed (reference number 130 of FIG. 1, discussed above, and step 450 in FIG. 4, discussed below), the control unit 220 again starts the operation of the registration unit 230 and the first driving unit 200 whose operations had been stopped. More specifically, the control unit 220 includes a first control unit 222 for controlling the registration unit 230, and a second control unit 224 for controlling the first driving unit 200 of the first auxiliary paper-feeding unit 202, and the second driving unit 210 of the second auxiliary paper-feeding unit 212.

Also, in the apparatus according to this embodiment, the first control unit 222 for registration unit 230, and the second control unit 224 for driving units 200 and 210 of the first and second auxiliary paper-feeding units 202 and 212 are all included in the control unit 220. However, the present invention is not limited thereto, and the first control unit 222 and the second control unit 224 may be physically separated. A structure in which the first control unit 222 for controlling the registration unit 230, and the second control unit 224 for controlling the driving units 200 and 210 of the first and second auxiliary paper-feeding units 202 and 212 are separated will be described later with reference to FIG. 3.

The first control unit 222 stops the operation of the registration unit 230 when the leading end of the sheet reaches a position within driving range of the registration unit 230. Hence, since the registration unit 230 is formed of two rollers contacting each other, the contacting area between the two rollers is the driving range of the registration unit 230. Thus, the first control unit 222 stops the operation of the registration unit 230 when the leading end of the sheet is located between the two rollers of the registration unit 230. Further, the first control unit 222 controls the registration unit 230 to transfer the leading end of the sheet once the image is completely formed on the photosensitive drum 131 (refer to FIG. 1).

The second control unit 224 stops the operation of the first driving unit 200, when operation of the registration unit (230) is stopped by signaling of an operation stop command from the first control unit 222 to the registration unit 230. Although at this point the leading end of the sheet that is being transferred from the first driving unit 200 of the first auxiliary paper-feeding unit 202 is located within the driving range of the registration unit 230, the length of the sheet is such that a part of the paper is also located at a position within the driving range of the first driving unit 200, the driving range being the contacting area between two rollers forming the first driving unit 200. Therefore, when the leading end of the sheet is located within the driving range of the registration unit 230, a part of the paper is also located at a position within the driving range of the first driving unit 200 because of the length of the sheet. As such, once the part of the sheet is located within the driving range of the first driving unit 200, the second control unit 224 stops the operation of the first driving unit 200. Thus, the second control unit 224 stops the first driving unit 200 when the part of the sheet is between the two rollers of the first driving unit 200 and the leading end of the sheet is within the driving range of the registration unit 230.

Moreover, the second control unit 224 controls the first driving unit 200 to convey the sheet when the registration unit 230 operates in response to the operation command by the first control unit 222. Therefore, when the registration unit 230 stops roller movement in response to the operation stop command by the first control unit 222 and the first driving unit 200 stops roller movement in response to the operation stop command by the second control unit 224, the sheet is prevented from being crumpled or bent along the paper conveying path 250 between the registration unit 230 and the first driving unit 200. Also, when the registration unit 230 starts roller movement in response to an operation command by the first control unit 222 and the first driving unit 200 starts roller movement in response to an operation command by the second control unit 224, the sheet continues to be conveyed along the paper conveying path 250.

In the above, the procedure of controlling the transfer of paper loaded in the first auxiliary paper-feeding unit 202 has been described. However, the present invention is not limited thereto, but may control the transfer of paper loaded in the second auxiliary paper-feeding unit 212. Hereinafter, a procedure for controlling the transfer of a sheet of paper loaded in the second auxiliary paper-feeding unit 212 will now be described with reference to FIG. 2.

The procedure for conveying the sheet loaded in the second auxiliary paper-feeding unit 212 is similar to that of conveying the sheet loaded in the first auxiliary paper-feeding unit 202. However, when the sheet is loaded in the second auxiliary paper-feeding unit 212, the second control unit 224 controls both of the second and first driving units 210 and 200 since the sheet can be located both in the second driving unit 210 and also in the first driving unit 200. More specifically, when the registration unit 230 stops roller movement in response to the operation stop command by the first control unit 222, the second control unit 224 stops roller movement in the first driving unit 200 or the second driving unit 210, wherever the sheet is located. That is, the second control unit 224 can stop roller movement in the first driving unit 200 first and then stop roller movement in the second driving unit 210. When the sheet that is being transferred is located in the first driving unit 200 but not in the second driving unit 210, the second control unit 224 only controls the first driving unit 200.

That is, the second control unit 224 controls the first and second driving units 200 and 210 to convey the sheet when the registration unit 230 operates in response to the operation command by the first control unit 222. In this case, the second control unit 224 may operate the first driving unit 200 first and then operate the second driving unit 210. In FIG. 2, the display unit 240 displays information whether the registration unit 230 is operating or stops operating and whether each of the first and second driving units 200 and 210 is operating or stops operating. Although the procedures for controlling the transfer of the paper from the first and second auxiliary paper-feeding units 202 and 212 have been described this second embodiment as shown in FIG. 2, a sheet of paper may be transferred from additional auxiliary paper-feeding units if the image forming apparatus has more auxiliary paper-feeding units than the ones of the present embodiment. Furthermore, the auxiliary units can be auxiliary paper trays that are installed in the image forming apparatus or auxiliary units that can be detached and used with more than one image forming apparatus.

Figure 3:
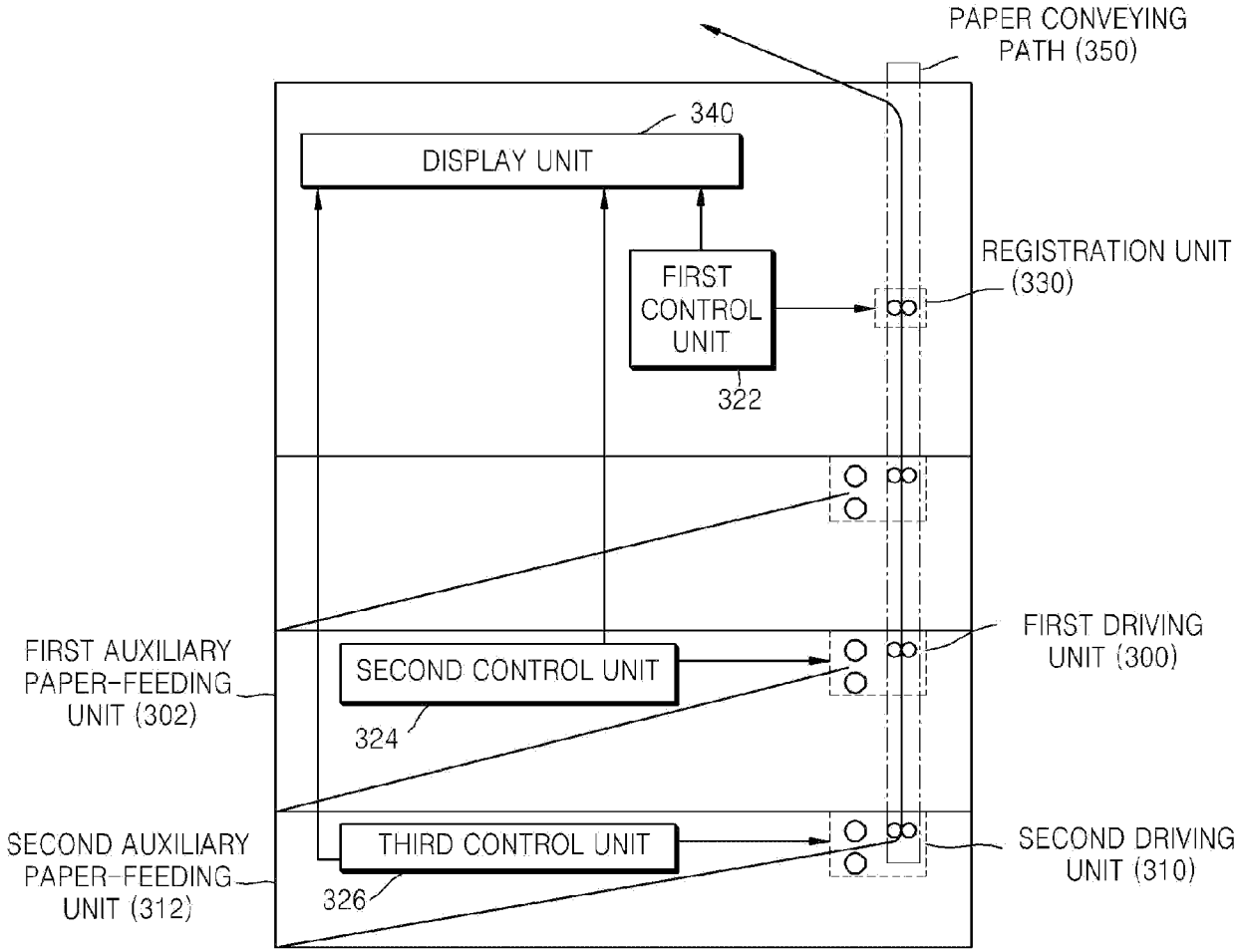
FIG. 3 is a diagram of an apparatus for controlling the transfer of paper according to a third embodiment of the present invention.

FIG. 3 is a diagram of an apparatus for controlling the transfer of paper according to a third embodiment of the present invention. The apparatus according to this third embodiment has a structure in which a control unit for controlling a registration unit, and a control unit for controlling a driving unit of an auxiliary paper-feeding unit are physically separated. Also, when there is a plurality of auxiliary paper-feeding units, the control units for controlling driving units of the auxiliary paper-feeding units are located in each of the auxiliary paper-feeding units.

That is, as illustrated in FIG. 3, when first and second auxiliary paper-feeding units 302 and 312 are arranged in the apparatus, a second control unit 324 for controlling a first driving unit 300 of the first auxiliary paper-feeding unit 302 is located inside the first auxiliary paper-feeding unit 302, and a third control unit 326 for controlling a second driving unit 310 of the second auxiliary paper-feeding unit 312 is located inside the second auxiliary paper-feeding unit 312. As illustrated in FIG. 3, the apparatus according to this third embodiment of the present invention includes the first and second auxiliary paper-feeding units 302 and 312. However, in this third embodiment, even though the apparatus may have more than two auxiliary paper-feeding units, the control unit for controlling the driving unit of each auxiliary paper-feeding unit is located in each auxiliary paper-feeding unit. That is, the apparatus according to this third embodiment of the present invention has the structure in which the control unit for controlling the registration unit, and the control units for controlling the driving units of the auxiliary paper-feeding units are physically separated, and the control units for controlling the driving units of the auxiliary paper-feeding units are individually located inside each of the auxiliary paper-feeding units. Because the operation of each of the control units is the same as those described with reference to FIG. 2, the descriptions for FIG. 3 and this third embodiment will be omitted here.

Figure 4:
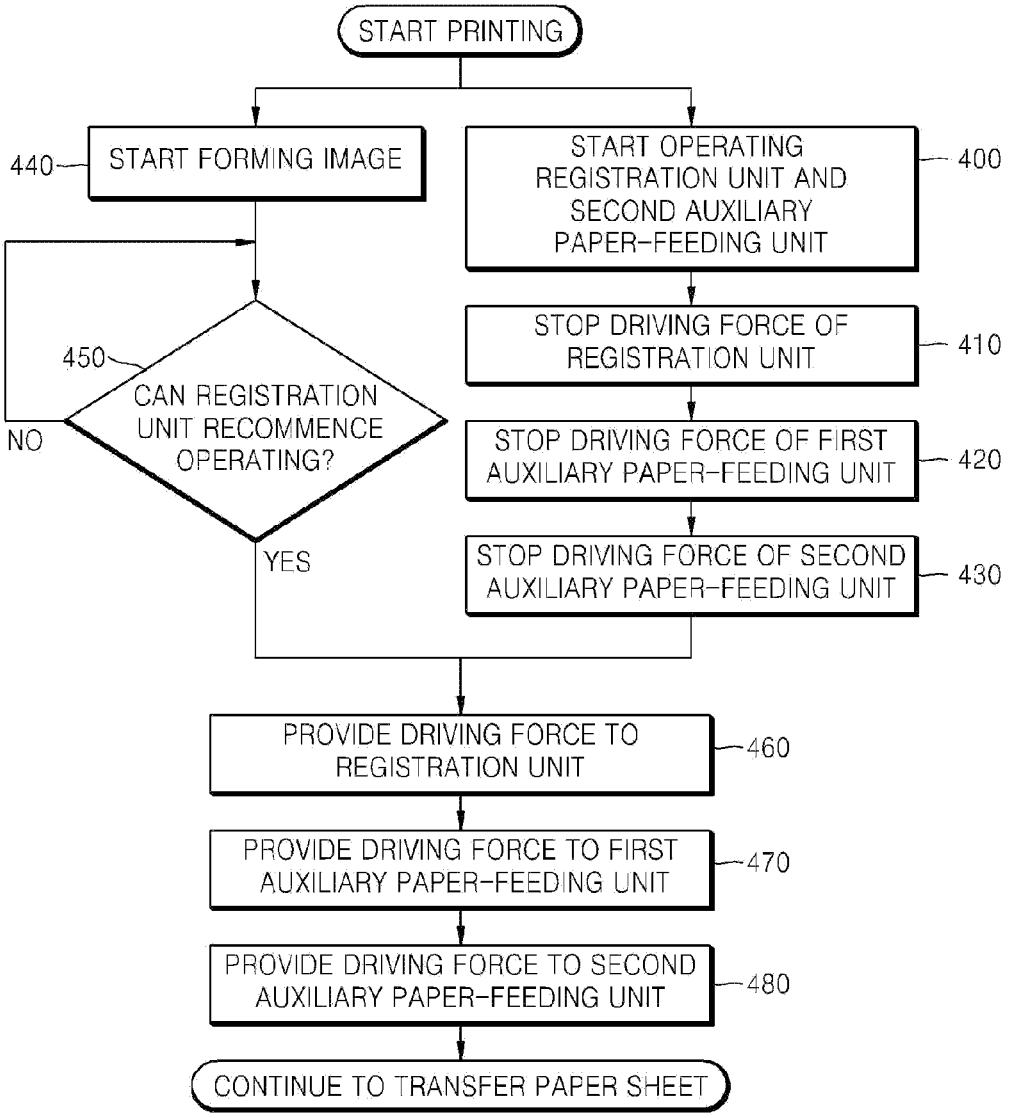
FIG. 4 is a flowchart of a method for controlling the transfer of paper according to a fourth embodiment of the present invention.

FIG. 4 is a flowchart of a method for controlling the transfer of paper according to a fourth embodiment of the present invention. Hereinafter, the method of controlling the transfer of paper will now be described with reference to FIGS. 2 and 4. More specifically, in this fourth embodiment, the image forming apparatus includes the first and second auxiliary paper-feeding units 202 and 212 as shown in FIG. 2 and the paper loaded in the second auxiliary paper-feeding unit 212 is being transferred.

In operation 400, when the printing starts, both the registration unit 230 and the second auxiliary paper-feeding unit 212 start operating. As the second driving unit 210 in the second auxiliary paper-feeding unit 212 operates, the paper loaded in the second auxiliary paper-feeding unit 212 is transferred along the paper conveying path 250 to the registration unit 230.

In operation 410, the driving force of the registration unit 230 is stopped. In detail, when the leading end of the sheet that is being transferred along the paper conveying path 250 arrives at the registration unit 230, the operation of the registration unit 230 is stopped so that the driving force of the registration unit 230 is stopped.

In operation 420, the driving force of the first auxiliary paper-feeding unit 202 is stopped. If a part of the sheet that is being transferred is located in the first driving unit 200 at the moment when the leading end of the sheet is halted, the operation of the first driving unit 200 is stopped.

In operation 430, the driving force of the second auxiliary paper-feeding unit 212 is stopped. If a part of the sheet that is being transferred is located in the second driving unit 210 at the moment when the leading end of the sheet is halted, the operation of the second driving unit 210 is stopped. However, if the length of the sheet is not long enough so that the sheet is located in the second driving unit 210, operation 430 is omitted.

In operation 440, which is performed independently from operation 410, an image starts to be formed. That is, an image is formed on the photosensitive drum independently from the processes of transferring the sheet so that the image can subsequently be formed on the sheet.

Operation 450 determines whether the registration unit 230 can recommence operating. In this case, the registration unit 230 can recommence operating once the image is completely formed on the photosensitive drum in operation 440. That is, if the image is completely formed on the photosensitive drum such that registration unit 230 can recommence operating, the method proceeds to operation 460. Otherwise, the method continues operation 440 until the image is completely formed on the photosensitive drum.

In operation 460, a driving force is provided to the registration unit 230. Since the signal from operation 450 has determined that the registration unit 230 can recommence operating, the registration unit 230 is controlled to operate so that the leading end of the halted sheet is transferred.

In operation 470, a driving force is provided to the first auxiliary paper-feeding unit 202. When the leading end of the sheet is transferred again by driving the registration unit 230, the first driving unit 200 is driven so as to transfer the sheet.

In operation 480, a driving force is provided to the second auxiliary paper-feeding unit 212. When the leading end of the sheet is transferred again by driving the registration unit 230, the second driving unit 210 is driven so as to transfer the sheet. However, if the length of the sheet is not long enough for the sheet to be located in the second driving unit 212, operation 480 is not performed. After operation 480, the transfer of the sheet continues. As discussed above, according to the second embodiment (FIG. 2) of the present invention, the display unit 240 of the image forming apparatus or a display unit of a host apparatus may display whether the registration unit 230 is operating or stops operating and whether each of the first and second auxiliary paper-feeding units 202 and 212 is operating or stops operating.

When the transfer of the sheet is controlled according to the method of FIG. 4, bending or crumpling of the sheet can be minimized as a result of the structure of the image forming apparatus of this aspect of the present invention. According to this aspect of the present invention, in order to align the leading end of the paper sheet, when the paper sheet arrives at a predetermined position of the image forming apparatus, the registration unit stops operating and the driving unit that transfers the paper sheet from the auxiliary paper feeding unit also stops operating so that bending and crumpling of the paper sheet can be minimized.

The embodiments of these aspects of the present invention can be written as computer programs and can be implemented in general-use digital computers that execute the programs using a computer readable recording medium. Also, the architecture of data used in these embodiments of the present invention can be written on a computer readable medium by use of various means. Examples of the computer readable recording medium include magnetic storage media (e.g., ROM, floppy disks, hard disks, etc.), optical recording media (e.g., CD-ROMs, or DVDs), and storage media such as carrier waves (e.g., transmission through the Internet).

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of controlling transfer of paper comprising:

stopping operation of a registration unit when a sheet of paper that is transferred from a plurality of auxiliary paper-feeding units of an image forming apparatus arrives at a predetermined position of the image forming apparatus so as to align a leading edge of the sheet at the registration unit; and in response to stopping of the registration unit, stopping operation of driving units of the plurality of auxiliary paper-feeding units that transferred the sheet, wherein the stopping of the operation of the driving units includes, upon a part of the sheet being located in a first driving units corresponding to one of the plurality of auxiliary paper-feeding units and another part of the sheet being located in a second driving units corresponding to another one of the plurality of auxiliary paper-feeding units, the first driving unit being a greater distance from the registration unit than the second driving unit, stopping an operation of the first driving unit, and stopping, at a later time, an operation of the second driving unit.

2. The method of claim 1, wherein each of the driving units includes at least one of a pick-up roller or a feed roller.

3. The method of claim 1, wherein in the stopping of the operation of each of the driving units, an operation of at least one of a pick-up roller or a feed roller, which forms each of the driving units, is stopped.

4. The method of claim 1, further comprising:

restarting the second driving unit, and then restarting the first driving unit when the stopped registration unit recommences operating.

5. The method of claim 1, further comprising:

restarting the stopped driving units when the stopped registration unit recommences operating.

6. The method of claim 1, further comprising:

displaying whether the registration unit is operating or stops operating and whether each of the driving units is operating or stops operating.

7. A non-transitory computer readable recording medium having embodied thereon a computer program when run on a computer for executing the method of claim 1.

8. An apparatus for controlling transfer of paper, the apparatus comprising:

a driving unit that transfers a sheet of paper loaded in an auxiliary paper-feeding unit;

a registration unit that aligns a leading edge of the sheet transferred from the auxiliary paper-feeding unit by the driving unit and further transfers the sheet; and a control unit that stops a driving force of the registration unit and, in response stops the driving unit when the leading edge of the sheet that has been transferred from the auxiliary paper-feeding unit, arrives at the registration unit, wherein the control unit comprises:

a first control unit that stops the driving force of the registration unit when the leading edge of the sheet that is transferred from the auxiliary paper-feeding unit arrives at the registration unit, and a second control unit that stops the driving unit upon the driving force of the registration unit stopping, wherein the second control unit stops operation of another driving unit of another second auxiliary paper unit when part of the sheet is located in a second driving unit, and wherein the second control unit stops the operation of the another driving unit and then stops the operation of the driving unit when part of the sheet is located in the another driving unit and another part of the sheet is located in the driving unit.

9. The apparatus of claim 8, wherein the driving unit includes at least one of a pick-up roller or a feed roller.

10. The apparatus of claim 8, wherein the second control unit stops the operation of the driving unit when part of the sheet is located in the driving unit.

11. The apparatus of claim 8, wherein when the first control unit drives the stopped registration unit, the second control unit first restarts the driving unit and then restarts the another driving unit.

12. The apparatus of claim 8, wherein when the first control unit drives the stopped registration unit, the second control unit restarts the driving unit.

13. The apparatus of claim 8, further comprising:

a display unit that displays whether the registration unit is operating or stops operating and whether the driving unit is operating or stopped operating.

14. An apparatus for controlling transfer of paper, the apparatus comprising:

a driving unit that transfers a sheet of paper loaded in an auxiliary paper-feeding unit;

a registration unit that aligns a leading edge of the sheet transferred from the auxiliary paper-feeding unit by the driving unit and further transfers the sheet;

a first control unit that stops a driving force of the registration unit when the leading edge of the sheet that is transferred from the auxiliary paper-feeding unit arrives at the registration unit; and a second control unit that stops operation of the driving unit in response to the stopping of the driving force of the registration unit stops, wherein the second control unit stops operation of another driving unit of another second auxiliary paper unit when part of the sheet is located in a second driving unit, and wherein the second control unit stops the operation of the another driving unit and then stops the operation of the driving unit when part of the sheet is located in the another driving unit and another part of the sheet is located in the driving unit.

15. The apparatus of claim 14, wherein the first control unit is located inside an image forming unit in which the registration unit is located, and the second control unit is located inside the auxiliary paper-feeding unit.

16. An apparatus for controlling transfer of paper, the apparatus comprising:

at least one driving unit that transfers a sheet of paper loaded in a corresponding at least one paper feeding unit;

a registration unit that aligns a leading edge of the sheet transferred from the at least one paper feeding unit by the at least one driving unit and further transfers the sheet; and a plurality of control units that respectively stop a driving force of the registration unit and the at least one driving units when the leading edge of the sheet arrives at the registration unit, wherein the plurality of control units comprises:

a first control unit that stops a driving force of the registration unit when the leading edge of the sheet arrives at the registration unit, and a second control unit that stops an operation of a first driving unit corresponding to one of the at least one paper feeding unit upon the driving force of the registration unit stopping, wherein the second control unit stops an operation of a second driving unit corresponding to another one of the at least one paper feeding unit when part of the sheet is located in the second driving unit, wherein the second control unit stops the operation of the second driving unit and then stops the operation of the first driving unit when part of the sheet is located in the second driving unit and another part of the sheet is located in the first driving unit and the first driving unit is a greater distance from the registration unit than the second driving unit.

17. The apparatus of claim 16, wherein the first control unit and the second control unit are located together in a master control unit.

18. The apparatus of claim 16, wherein the first control unit is a separate unit from the second control unit.

19. The apparatus of claim 16, wherein the at least one paper feeding units is a primary paper feeding medium fixed in one image forming apparatus and another of the at least one paper feeding units are detachable and can be used in other image forming apparatuses.

* * * * *

UNITED STATES PATENT AND TRADEMARK OFFICE

CERTIFICATE OF CORRECTION

PATENT NO. : 8,408,541 B2
APPLICATION NO. : 12/252771
DATED : April 2, 2013
INVENTOR(S) : Hyun-soo Song It is certified that error appears in the above-identified patent and that said Letters Patent is hereby corrected as shown below:

In the Claims:

Column 8, Line 32, In Claim 1, delete “units” and insert -- unit --, therefor.

Column 8, Line 34, In Claim 1, delete “units” and insert -- unit --, therefor.

Column 10, Line 21, In Claim 16, delete “units” and insert -- unit --, therefor.

Column 10, Line 50, In Claim 19, delete “units” and insert -- unit --, therefor.

Signed and Sealed this
Thirteenth Day of August, 2013

Teresa Stanek Rea
*Acting Director of the United States Patent and Trademark Office*